United States Patent [19]

Bradley

[11] Patent Number: 4,962,897

[45] Date of Patent: Oct. 16, 1990

[54] WEB WINDING MACHINE AND METHOD

[75] Inventor: John J. Bradley, Green Bay, Wis.

[73] Assignee: Paper Converting Machine Company, Green Bay, Wis.

[21] Appl. No.: 327,721

[22] Filed: Mar. 23, 1989

Related U.S. Application Data

[62] Division of Ser. No. 138,661, Dec. 28, 1987, Pat. No. 4,856,725, which is a division of Ser. No. 845,187, Apr. 1, 1986, Pat. No. 4,723,724.

[51] Int. Cl.[5] ..... B65H 18/22; B65H 19/22

[52] U.S. Cl. ..... 242/67.1 R; 242/56 R; 242/66

[58] Field of Search ..... 242/56 R, 56 A, 56.8, 242/67.1 R, 67.2, 67.3, 75.1, 55.1, 66, 74

[56] References Cited

U.S. PATENT DOCUMENTS

| | | | |
|---|---|---|---|
| 2,361,265 | 10/1944 | Christman | 242/56.8 |
| 3,148,843 | 9/1964 | Turner et al. | 242/56 A |
| 3,782,650 | 1/1974 | Donnell | 242/56.8 |
| 3,881,665 | 5/1975 | Leloux | 242/67.3 R |
| 4,327,877 | 5/1982 | Perini | 242/66 |
| 4,487,377 | 12/1984 | Perini | 242/56.8 |

FOREIGN PATENT DOCUMENTS

| | | | |
|---|---|---|---|
| 2105688 | 3/1983 | United Kingdom | 242/56.8 |

*Primary Examiner*—John M. Jillions

*Attorney, Agent, or Firm*—Tilton, Fallon, Lungmus & Chestnut

[57] ABSTRACT

A surface winder is provided for developing rolls of web material wound on a core including a magazine for dispensing cores sequentially and a nip for receiving cores sequentially, the core transport means between said source and nip arranged to follow a generally hypocycloidal path to provide cusps for adhesive application to the core and for introducing cores into the nip, a surface winder including a pair of winding belts traveling at different speeds and in different directions, and web severence means including a pair of web pinching points one of which is on the moving web and the other on a stationary part of the web.

10 Claims, 5 Drawing Sheets

FIG. 1
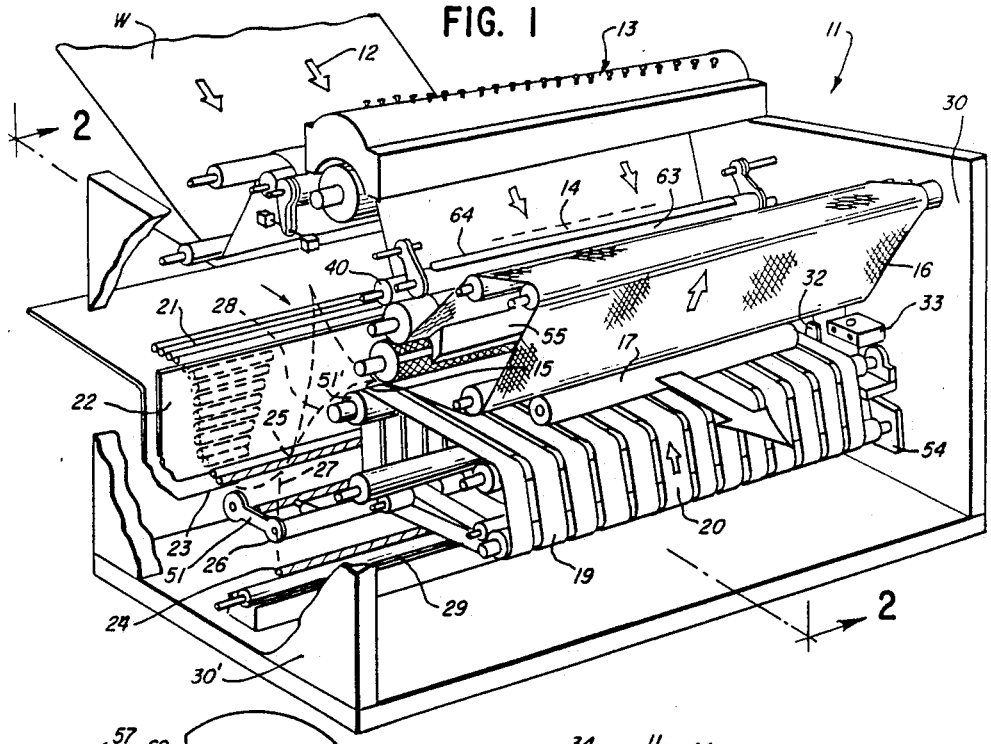
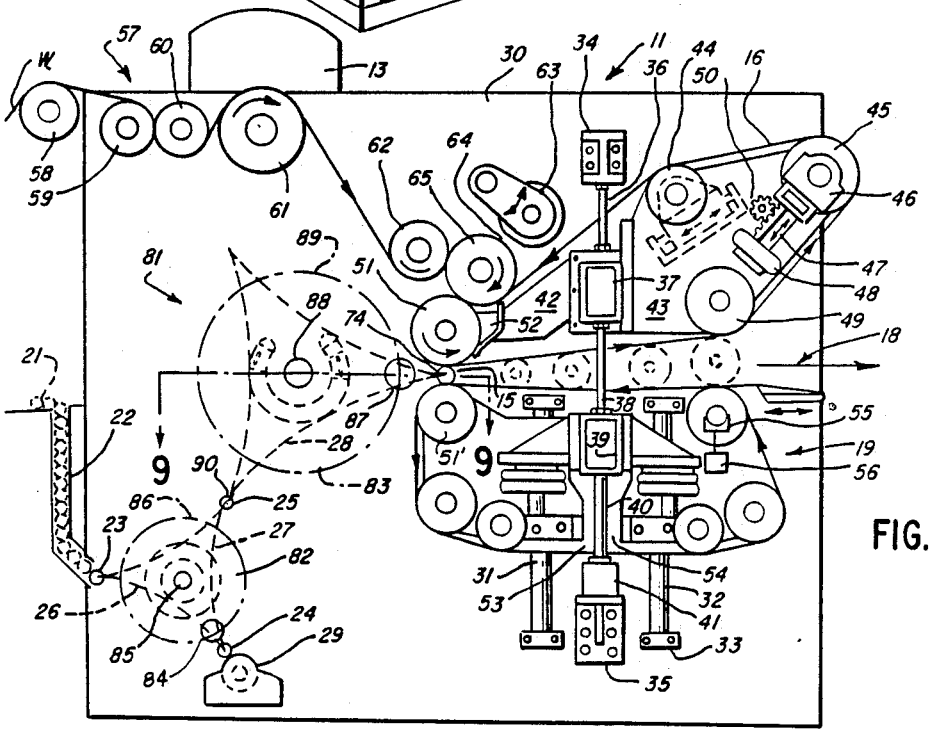
FIG. 2

WEB WINDING MACHINE AND METHOD

This application is a division of application Ser. No. 138,661 filed Dec. 28, 1987 now U.S. Pat. No. 4,856,725 which, in turn, was a division of Ser. No. 845,187 filed Apr. 1, 1986, now U.S. Pat. No. 4,723,724.

BACKGROUND OF THE INVENTION

This invention relates to a method of web winding and machine therefor and, in particular, to a surface winder.

In web winding these are two basic methods for winding a web on a series of cores. These are center winding and surface winding. In center winding, a core is mounted on a mandrel which rotates at high speed at the beginning of a winding cycle and slows down as the diameter of the log being wound builds up.

In surface winding the core and web being wound thereon are driven by contact with belts, rotating rolls, or the like, which operate at or near web speed.

Illustrative of belt surface winding is U.S. Pat. No. 3,148,843. More recently, the art has gone to rotating cradle rolls as illustrated by U.S. Pat. No. 4,327,877.

SUMMARY OF THE INVENTION

The invention provides a surface winding machine in which the core is inserted into the nip between two co-acting belt systems which are slightly divergent. The belts in the two co-acting systems travel in opposite directions at constant but different velocities, and the resultant velocity differential between the belts causes a steady advancement of the core and log being wound during the winding cycle from core insertion to wound log discharge.

While core inserting systems are known for surface winders, the invention provides a unique core transfer/-feeder system based on hypocycloidal motion. This motion yields a precise and repeatable core insertion which can be advantageously employed in prior art machines as well as the dual belt surface winder described herein.

The invention also includes a novel method and apparatus for severing a perforated web being wound which facilitates continuous, high-speed operation. The web, while being advanced along a path, is pinched at a first point. At the time of proposed severance a core is used to pinch the web against a stationary plate at a second point upstream of the first point and while a line of perforations is positioned between the two points. Because the web is advancing at the first point and stationary at the second point, the web is under increasing tension which causes it to snap at the line of perforation.

DESCRIPTION OF THE DRAWINGS

The invention will be explained in conjunction with an illustrative embodiment shown in the accompanying drawings, in which FIG. 1 is a fragmentary top perspective view of the inventive machine from the product discharge end, FIG. 2 is a sectional view taken along line 2—3 of FIG. 1;

DETAILED DESCRIPTION

Operation in General

Figure 3:
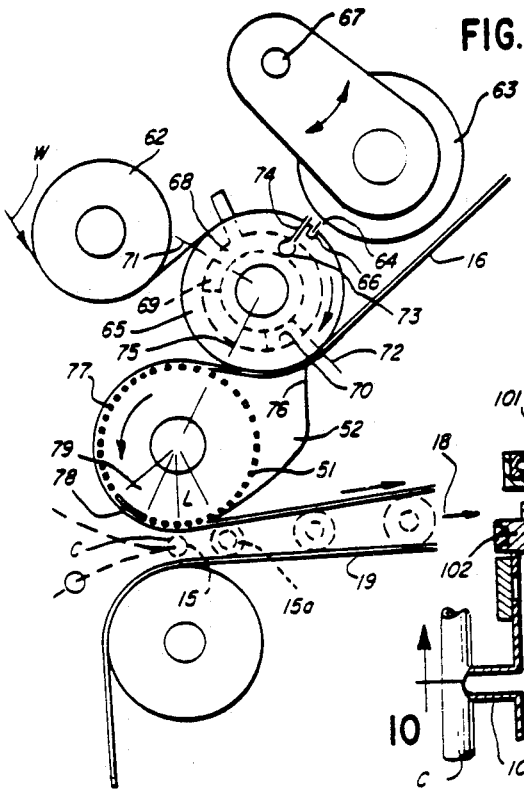
FIG. 3 is an enlarged fragmentary view of FIG. 2.

Referring to FIG. 1, a rewinder or web winding machine 11 processes a web W in the direction of arrow 12. After processing it through a perforator 13 which puts transverse lines of perforation 14 across the web, the web is transferred through a series of rolls and finally is transferred to a pre-glued core at the nip position 15—see also the core C at the lower left in FIG. 3.

It is subsequently wound between an upper belt system 16 which contacts the top of a web-wound core (ultimately the log 17) which moves along a path in the direction of arrow 18—see the right hand portion of FIGS. 2 and 3—and a lower belt system 19 which moves in the direction of arrow 20 at a different speed which is less than the speed of upper screen belt system 16. The belts are advantageously driven through the rolls which define nip 15.

A series of cores 21 (see the left hand portion of FIG. 2) is fed through a chute 22 to position 23 from which the cores are transferred by two assemblies which travel in a three-cusp hypocycloidal motion, as shown by the dotted lines 26, 27 and 28, to the nip position 15. Referring to FIG. 2, the core transfer device with the just-mentioned hypocycloidal motion picks up a core at position 23 and transfers it to position 24 where it comes into contact with a roll 29 having glue on its surface. The roll 29 is arranged to apply an interrupted line of adhesive to the core.

The first assembly with hypocycloidal motion then moves the core from position 24 to position 25 where it is transferred to, and is then under control of, a second assembly with hypocycloidal motion. The second assembly grips the core between glue segments and moves the core from position 25 to the nip position 15. The nip 15 is approximately equal to the outside diameter of the core and represents the minimum distance between upper belt system 16 and lower belt system 19.

Prior to this instant, the perforated web is carried forward around a series of rolls until it contacts the line of adhesive on the core and is thus transferred to the core. The now-rotating core and web being wound move from position 15 in the direction of arrow 18 until the log is completely wound, as at position 17—see FIG. 1. Conventional equipment can be used for transferring the wound logs to subsequent operations, such as cutting into individual consumer size rolls, wrapping and cartoning.

Upper and Lower Belts Generally

The perspective view of FIG. 1 also shows that the upper screen belt system 16 and associated rolls are generally cantilever mounted on one side frame 30. Thus, the upper belt system is not movable, but the screen can be removed and replaced from one side. Likewise, the lower belt system 19 (having a plurality of belts and associated parts) is generally cantilever mounted on a subframe (not shown) which is vertically movable on slide shafts 31, 32 (see the lower right hand portion of FIG. 2). Blocks 33 mount shafts 31 and 32 securely to side frame 30. Thus, the lower belt system can be adjusted up or down relative to the fixed upper belt system, and the gap therebetween can be varied to compensate for differences in core diameter.

The front or operating side of the machine has a side frame 30', illustrated only fragmentarily and at the lower left in FIG. 1. This frame is cast with openings to remove the two belt systems. It also provides a means for mounting upper and lower brackets 34 and 35—see the central right portion of FIG. 2. The brackets 34 and 35 serve as the means for supporting the cantilevered sides of the two belt systems 16 and 19.

Still referring to FIG. 2, it will be seen that the upper belt front support includes a first jack screw 36 extending downwardly from bracket 34. This engages the upper end of a transverse beam 37 which is the main support member for the upper belt system 16.

Extending downwardly from beam 37 is a second jack screw 38 which is threadably received in beam 39—the one that carries the lower belt system 19. Extending downwardly from beam 39 is a third jack screw 40 which, at its lower end, is threadably received in rotary jack 41 mounted on bracket 35.

The upper beam 37 is rigidly mounted on the rear frame 30 and the lower beam is slidably mounted relative to the rear frame 30 on the aforementioned slide shafts 31, 32. Thus, by removing the three jack screws 36, 38 and 40, the front end of each of the beams 37, 39 is unsupported and the upper and lower belts may be removed and replaced.

Upper Belt System Details

The upper beam 37 is equipped with a pair of longitudinally-extending wings—longitudinal in the sense of the direction of web travel in the machine. These wings 42, 43 (see the central right hand portion of FIG. 2) support the various rolls that carry the upper belt.

Since the upper screen is of a width corresponding to web W, it is desirably guided. For this purpose, idler roll 44 is arranged with one journal mounted in a commercially available "cocking" device and which skews the roll as a function of a screen edge guide sensor (not shown). In this fashion, the full width screen is guided around the multi-roll assembly. Upper roll 45 is supported on each end by bearing blocks 46 which, through jacks 47, are movable in either direction at the urging of pneumatic pillows 48. To insure parallel movement of the roll 45 relative to idler roll 49, pinions 50 are mounted on a common cross shaft. The other roll associated with the upper screen belt assembly is a vacuum transfer roll 51 operating in conjunction with vacuum chamber 52, both of which are supported from the main upper beam 37 through the wing 42.

Lower Belt System Details

As mentioned previously, the support for the lower belt system is the transverse beam 39. This is adjustable vertically by means of rotary jacks 41 (front and rear). The beam 39 likewise carries a pair of longitudinally extending wings 53, 54 which carry the various supporting rolls. Through the operation of the jack screws 38, 40 the height of the beam 39 can be varied, thereby adjusting the distance between the upper and lower belt system. The rotary jacks are employed for aligning the ends of the beam 39. The lower belt is advantageously driven through the lower roll 51' of the nip 15.

To compensate for different finished roll diameters, the roll 55 (indirectly carried by the wing 54) can be adjusted vertically. This is achieved by further rotary jacks 56 mounted on the wings 43. Here it will be appreciated that, for the sake of clarity or presentation, only the front wing has been shown, but in accordance with established machine practice, similar supporting means are provided on the rear side.

Referring now to the upper left portion of FIG. 2, the major components in the web path first include a web draw roll section generally designated 57. Provide as part of this section is a spreader roll 58 and two coacting draw rolls 59, 60 which have an adjustable nip and can be variable speed controlled. The perforating component 13 includes a perforating head having anvils mounted therein and a perforating roll 61 which has perforating blades, generally as seen in U.S. Pat. No. 2,870,840.

The cutoff and transfer section includes four rolls consisting of a roll 62, a pivotable cutoff roll 63 having blades 64 mounted therein, an anvil-bedroll 65 and the transfer roll 51. Details of the cutoff and transfer section are shown in FIG. 3, the details of the transfer sequence are shown in FIGS. 4–8.

Cutoff and Transfer

FIG. 3 is an enlarged view of the cutoff and transfer roll assembly shown in FIG. 2. Web W wraps roll 62 which is driven at web speed and roll 62 may be in contact with anvil roll 65 is desired. When the web passes roll 62 and is entrained on the surface of roll 65, it bridges slot 66. The cutoff roll 63 mounted to pivot about shaft 67 is arranged with the blade 64 extending radially outward of its periphery. When slot 66 is rotated to about the two o'clock position as shown in FIG. 3, roll assembly 63 is pivoted downward so blade 64 will puncture the web and produce a free leading edge. Vacuum from an external source (not shown) is applied to concentric slot 68 of an external vacuum manifold. By use of inserts 69 and 70, which are adjustable, that portion of the concentric slot 68 extending clockwise from line 71 to line 72 is vacuumized. Details of the external vacuum manifold are well known and are generally described in co-owned U.S. Pat. Nos. 3,490,762 and 3,572,681.

While roll 65 rotates from position 71 at about ten o'clock until it reaches line 72 at about five o'clock vacuum manifold slot 68 communicates with the transverse vacuumized passage 73. Through a series of radial ports 74 aligned transversely across the face of roll 65 and directly behind slot 66, vacuum is provided to control the leading edge of the severed web segment. This leading edge is held on the periphery of roll 65 by vacuum until it reaches line 72 at the five o'clock position and from there until about the seven o'clock position at line 75, it will be entrained on the surface of the roll 65 by the upper screen belt 16.

Vacuum chamber 52 which includes transfer foll 51, has an upper lip 76 which extends to about the four o'clock position relative to roll 65 and serves to limit the extent of vacuum chamber 52 at that location, as shown. This permits the vacuum in chamber 52 to act upon the web W before it leaves roll 65 ensuring reliable transfer of web W onto the upper screen belt 16.

Transfer roll 51 is essentially a hollow roll with a series of holes or apertures 77 in the surface thereof. Advantageously, commercially available materials such as expanded metal grating or other apertured metallic plates, can be used for the porous surface of roll 51. It is noted that a strip 78 installed parallel to the axis of the roll does not permit vacuum to be effective in arcuate portion 79 on the surface of roll 51.

When the leading edge of the cut web, carried on the upper screen belt 16 by vacuum from chamber 52, approaches roll 51 at about 12 o'clock, it is matched with the leading edge of strip 78 so that a portion of the cut web, approximately equal in length to strip 78 is not held onto screen belt 16 as it wraps around roll 51. This leading web portion, from leading edge to the trailing edge of strip 78 folds back onto the following portion of the web which is securely held against screen belt 16 as it wraps around roll 51 by the vacuum in chamber 52. This fold back occurs during the movement of strip 78 from 12 o'clock on roll 51 to 6 o'clock where the nip 15 is formed so that fold back is present at the instant of transfer to a new core at nip 15. The length of the fold back is determined by the length of strip 78. Fold back is not necessary for single ply webs but is advantageously with webs of two or more plies.

At the instant the leading edge of folded portion reaches the six o'clock position, a core C is inserted as shown in phantom and is instantly trapped in the nip between upper belt 16 and lower belt 19 as shown in position 15. As soon as the core contacts both upper and lower belts, it begins to rotate in a clockwise direction and almost instantaneously, the velocity of its surface equals web speed. If both belts were traveling at the same velocity, but in opposite directions as shown, the core would remain stationary directly below the six o'clock position of transfer roll 51. However, the velocity of lower belt 19 is less than upper screen belt 16, and this difference in belt velocities results in movement of the core and the roll being wound successively from nip position 15, this movement of the progressively wound log being in the direction of arrow 18.

Figure 7:
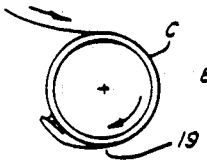
Figure 8:
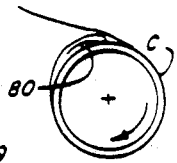

FIGS. 4–8 show the transfer of reverse folded web as it approaches nip line 15'. There it contacts core C with glue stripes 80, is glued (see FIGS. 5 and 6) as it beings to rotate downwardly and as it rotates past bottom belt contact point 19 (FIG. 7). In FIG. 8, the leading edge of the web is secured to the core by glue stripe 80 by completing one wrap and is thereafter trapped by oncoming web segment until the winding process is completed, analogous to co-owned Re. U.S. Pat. No. 28,353.

It will be recognized that the multiple apertures 77 result in a very porous surface of transfer roll 51 which, at the same time, allow high flow rates through that portion of the porous surface that is enclosed within the extended lip portions of vacuum chamber 52, (see FIG. 3). While other arrangements are possible, a hollow construction with a porous surface of roll 51 is preferred, since the arrangement shown makes possible the use of continuous vacuum as opposed to very costly and complicated vacuum systems that require cycling vacuum pressures. This is particularly advantageous in achieving high speeds and also in overcoming the normal difficulty in obtaining uniform vacuum across a roll, especially when wider machines are involved.

Core Transport and Feeding

Figure 9:
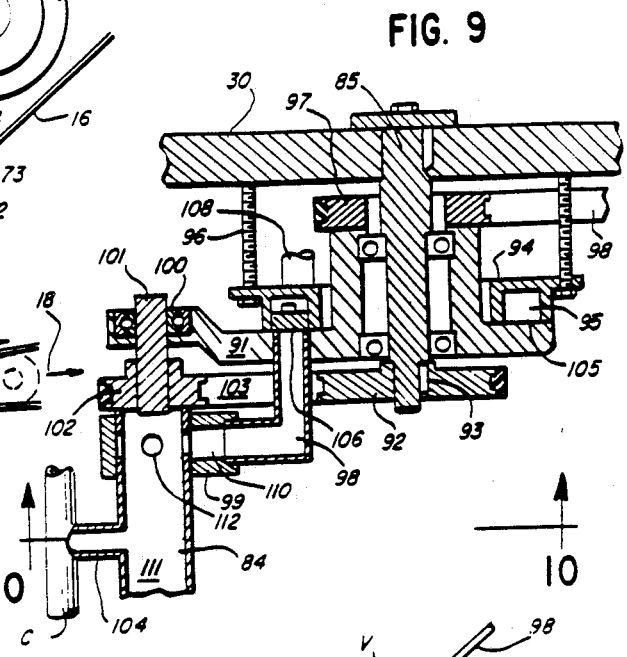
FIG. 9 is a sectional view of one end of a core feeding device viewed essentially along the line 9—9 of FIG. 2.
Figure 10:
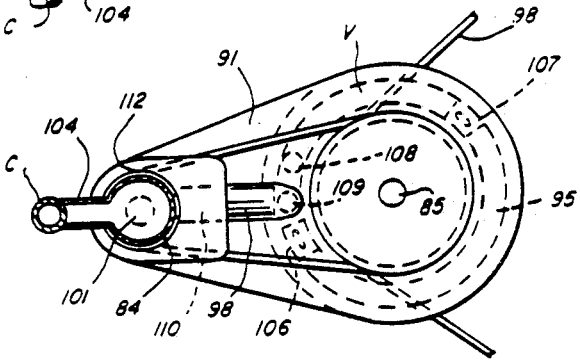
FIG. 10 illustrates a portion of the core feeding assembly viewed along line 10—10 of FIG. 9.
Figure 4:
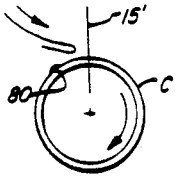
FIGS. 4–8 are schematic views illustrating the sequence of web transfer.
Figure 5:
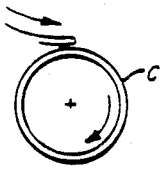
Figure 6:
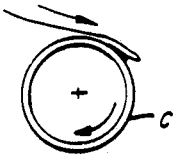

The core feeding section generally designated 81 includes two rotating assemblies 82 and 83—see FIG. 2. Each develops a three-cusp hypocycloidal motion which is advantageous in transferring the core from the pickup position 23—see FIG. 2—to the gluing position 24, a transfer position 25 and a nip insertion position 15. Details of this particular mechanism are seen in FIGS. 9 and 10. Each of the assemblies 82 and 83 are similar in construction and motion, but are dimensioned differently for this particular arrangement. For example, a rotating vacuum roll 82 (see left bottom corner of FIG. 2)—rotates about shaft 85 in an orbit 86 shown in phantom. Upper transfer assembly 83 has a similar rotating vacuum roll 87 rotating about axis 88 in an orbit 89—also shown in phantom.

Essentially, the lower transfer assembly 82 picks up cores at position 23 and moving through a hypocycloidal path, moves the core to position 24 where an interrupted axially-extending glue line is applied by glue roll 29, and subsequently moves the core to position 25. The core is held on the transfer assembly by vacuum. With the hypocycloidal motion, it is noted that a glue line printed on the outside of the core at position 24 shows at transfer position 25 as a glue line in position 90—see FIG. 2. At position 25, vacuum on the lower assembly is shut off and the vacuumized roll 87 on the upper transfer assembly takes over control of the core and moves it to the nip position.

The hypocycloidal motion of the core is achieved in the illustrated embodiment by orbiting a vacuum roll 84 about the axis of shaft 85 (see FIG. 2)—while at the same time rotating the roll 82 relative to arm 91—see FIG. 10. The arm 91 is rotatably mounted on shaft 85. In FIG. 9, certain parts are stationary and include the shaft 85 keyed to side frame 30, and an attached pulley 92 also keyed as at 93 to shaft 85. A vacuum valve 94, having a concentric vacuum manifold 95, is attached to the stationary frame 30 via bolts 96. Thus, it too remains stationary.

The moving parts include pulley 97 rotatably mounted on shaft 85, being driven by belt 98 from an external source and synchronized with cutoff and transfer. The arm 91 is secured to pulley 97 and carries vacuum connecting pipe 98 and sleeve 99 to rotate about shaft 85.

The end of arm or bracket 91 supports bearing 100, roll journal 101, pulley 102 attached thereto and vacuum roll 84. While these parts also orbit, they rotate relative to arm 91 due to action of belt 103 which is entrained around fixed pulley 92 and pulley 102. The diameter of pulley 92 is two times that of pulley 102 which thus produces the three cusp hypocycloidal motion.

The rotation of pulley 102 causes vacuum roll 84 to rotate and with it vacuum pucks or nozzles 104 and core C—about an axis provided by journal 101. This combined motion results in the center of the core tracing a hypocycloidal curve—see phantom lines FIGS. 1 and 2 similar to that provided in co-owned U.S. Pat. No. 3,994,486.

Referring to FIG. 9, stationary vacuum valve 94 bears against finished surface 105 of the rotating arm 91. The circular vacuum manifold 95 contains inserts 106, 107, which are spaced apart and define a vacuum zone V. This zone is vacuumized through an external connection 108 leading to a vacuum source (not shown).

Vacuum applied through pipe 108 communicates with the circular manifold 95 and when the opening 109 of pipe 98 communicates with vacuum zone V, vacuum is transmitted through vacuum pocket 110 of sleeve 99 to the central hollow chamber 111 of roll 84 through a series of ports 112 which communicate with pocket 110. In this manner, vacuum can be applied to the axially-spaced vacuum pucks over a selected portion V of the orbit in any predetermined or programmed manner and as vacuum force is needed to pick up, hold and release the cores.

Operation of Core Transport

To achieve the hypocycloidal motion of the core, it is orbited about the axis of the fixed shaft 85 or 88 while being revolved about the axis of the core transport roll 84 or 87. In the illustration given, there are three revolutions per orbit but any other integer number can be used, depending upon the geometry of the system. It will also be appreciated that gears or other transmission couplings may be employed in place of the first pulley means 97, 98 for rotating the arm 91 to orbit the core transport roll 84 or 88 and the core C—and in place of the second pulley means 92, 102, 103 for rotating the core transport roll 84 or 88 to cause the core C to revolve around the core transport roll 84 or 88. The core C is offset from the axis of the core transport roll 84 or 87 by the use of generally radially extending puck means 104.

The cores are sequentially engaged and released, in the illustration given, by vacuum. However, depending upon the system geometry, other engaging/disengaging means may be employed such as pins or grippers on the core engaging member 84 or 87. Vacuum is preferred because it minimizes the use of moving parts.

For example, the only movement in the vacuum system illustrated is that of the vacuum pipe 98 past the vacuum manifold 95 (see FIG. 9) and the rotation of the ports 112 past the sleeve 99. Limiting the effect of the vacuum—and thereby the ability of the puck means 104 to maintain the cores in engaged relation—is readily achieved by blocking off parts of the manifold 95 by the inserts 106. The location of the inserts thus programs the clamping and unclamping of the cores by the core transport roll means 84, 87.

Also in the illustration given, I make the orbit 89 substantially larger than the orbit 86. This permits the use of longer puck means 104 and thereby develops a longer, narrower cusp to facilitate insertion of the core in to the nip 15. It also means that the puck means 104 are equally quickly retracted from the vicinity of the nip so as not to interfere with the winding of the roll being wound.

Figure 3A:
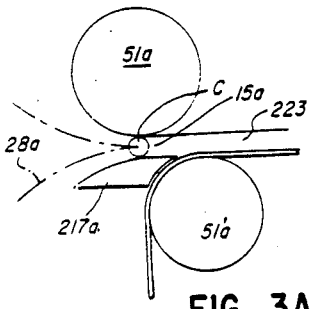
FIG. 3A is a fragmentary view constituting a modification of FIG. 3.

Reference is now made to FIG. 3A which shows a modified form of the belt surface winder and focusing on the parts thereof originally described with respect to FIG. 3. The essential difference between the showing in FIG. 3A from that of FIG. 3 is in the core insertion nip which in FIG. 3A is designated 15*a*. Reference to FIG. 3A shows that the lower roll 51'*a* has been displaced downstream from the location in FIG. 3 and the core insertion nip 15*a* is now developed by the upper roll 51*a* and a stationary plate 217*a*. The purpose of providing the stationary plate 217*a* is to get the core C away from the core inserting mechanism more rapidly. The core inserting mechanism is depicted only schematically by the fragmentary cusp designated 28*a* which is the path followed by the center line of the core when the same is supported by the vacuum puck means 104. This results in a simplification of the core inserting means 81 because there does not have to be quite as a rapid a withdrawal of the vacuum puck means 104.

Also in this connection it will be noted that there are two nips provide, in effect. There is the core insertion nip 15*a* and then downstream a short distance therefrom a second nip, the belt system nip 223. The nip 223 is that developed between the cooperative action of the upper and lower belt systems. In the embodiment of FIGS. 1–10, the single nip 15 accommodated both the function of core insertion and the initiation of the double belt system winding. In this modification, the first nip 15*a* still accommodates the core insertion function but the second nip 223 is the one that accommodates the initiation of double belt system winding.

MODIFICATION OF FIGS. 11–17

A simple yet advantageously effective modification of the surface winder of the type just described is illustrated in FIGS. 11–17. It is simple because it eliminates the following:

(1) the mechanism which cuts off the web before transfer consists of two driven rolls and a complex cam mechanism for moving one of the rolls for cutoff;

(2) the vacuum pump and system which carries the cutoff web to the point of transfer to the new core;

(3) the upper vacuum screen and guiding system; and (4) one of the two hypocycloidal core handling mechanisms.

Figure 11:
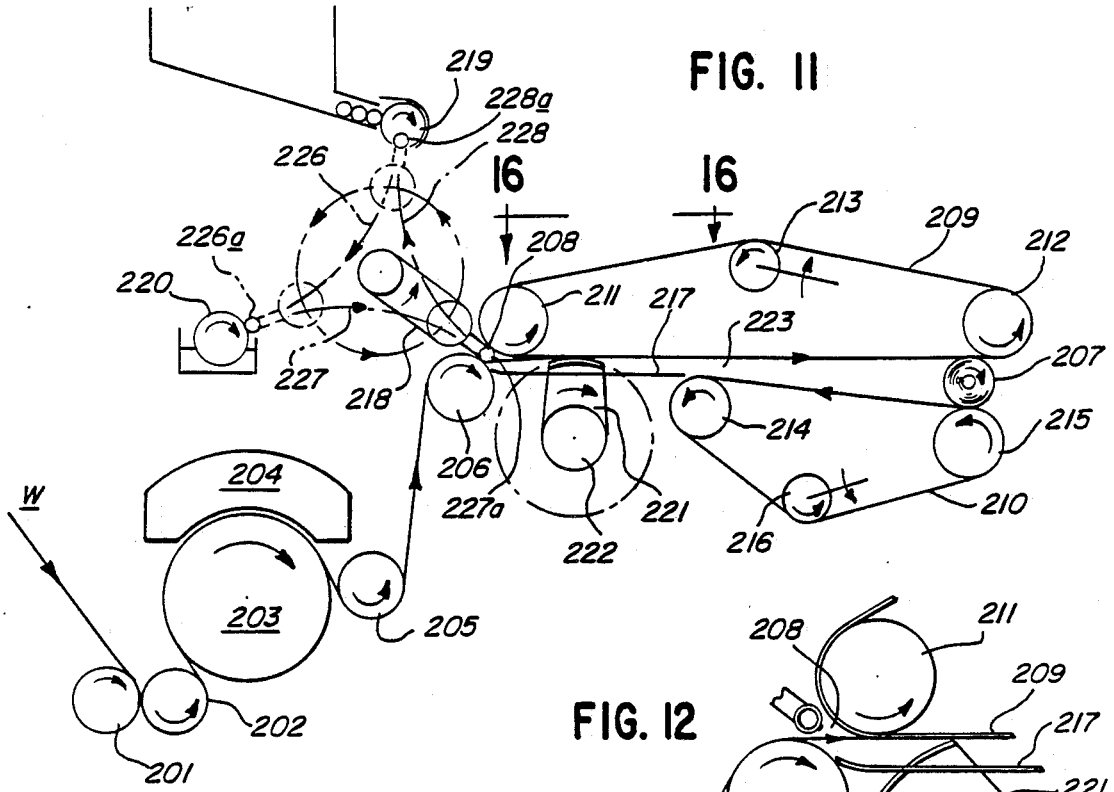
FIG. 11 is a schematic side elevational view of a modified form of surface winder.

Reference is now made to FIG. 11 which shows the modified rewinder at the moment when the log being wound is finished and a new core has been inserted into the transfer nip.

The web W enters the machine at the left after being unwound from a parent roll (or parent rolls) and processed by embossing, laminating, printing, etc. It wraps draw rolls 201 and 202 which feed the web to the perforator roll 203. Draw roll 202 is normally located at 9 o'clock relative to the perforator roll 203 but in this case it is moved to about 7 o'clock to provide access to the perforator roll surface (7 o'clock to 10 o'clock) for changing perforator blades. The perforator roll 203 contains flexible perforating blades which perforate the web by acting against anvils in the stationary perforator bar 204. Blades and anvils are not shown in order to simplify the sketch.

Figure 12:
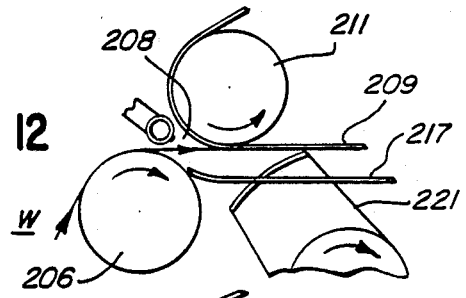
FIGS. 12–15 are enlarged fragmentary views of the central portion of FIG. 11 and illustrate the sequence of web cutoff and transfer.

The web then wraps idling guide roll 205 and driven roll 206, and continues onto the log being wound 207, passing through the core insertion nip 208—see FIG. 12 which shows the web path just after roll 206 in larger scale. The log being wound 207 which cause both rotation/winding of the log being wound and also horizontal movement of the log being wound from transfer to completion during the winding cycle. The surface speed of roll 206 and the speed of upper belts 209 are the same and very close (+0% to +5%) to web speed which is set by draw rolls 201 and 202 and perforator roll 203.

Figure 17:
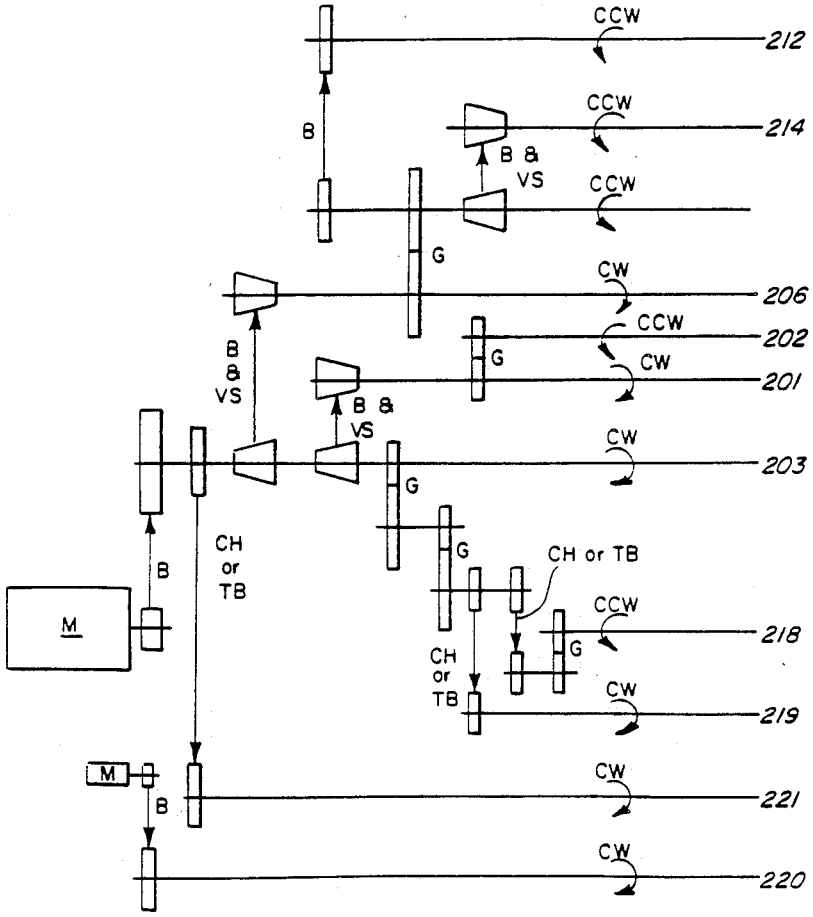
FIG. 17 is a schematic view of the drive system for the winder of FIG. 11.

The speed of the lower belts 210 is less than the speed of the upper belts 209 by an amount which causes the log being wound to reach position 207 (approximately)

at the completion of winding. This speed difference is about 3% to 10% of web speed, and it is adjusted, by the operator, to match the length of web in the finished log (see FIG. 17 which is a Drive Schematic). In FIG. 17, the following symbols are employed:

"CW" refers to clockwise rotation
"B" refers to counterclockwise rotation
"TB" refers to timing belt drive
"CH" refers to chain drive
"G" refers to gear drive
"VS" refers to variable speed device
"M" refers to motor The upper and lower belts 209 and 201 are actually several narrow belts (5–6 inches wide) which are close together (1–2 inch gap between belts) and cover the entire web width. The gaps between the upper belts are centered opposite lower belts and vice versa so the entire width is covered by at least one belt during winding.

Rolls 211 and 212 establish the working line of upper belts 209. Roll 212 is the drive roll. Roll 211 is adjustable toward roll 206 to adjust the core insertion nip 208, to match core diameter (½ inch to 2 inches range). Roll 212 is in a fixed position which is not adjustable. Rolls 213 are several rolls, one for each belt or upper belts 209, and they are air or spring loaded against their belts to act as belt tighteners and hold all belts at equal operating tension.

Rolls 214 and 215 establish the working line of lower belts 210. Roll 214 is the drive roll, and it is also adjustable vertically to match core diameter. Roll 215 is adjustable vertically to match finished log diameter (2 inches to 6 inches is usual range). Rolls 216 are several rolls, one for each belt of lower belts 210 and they are air or spring loaded against their belts to act as belt tighteners and hold all belts at equal operating tension.

A stationary plate 217 spans the distance from roll 206 to the belts on roll 214. The core, with the initial wraps of web after transfer, rolls along stationary plate 217, driven by upper belts 209. The stationary plate is adjustable vertically to match core diameter.

FIG. 11 shows the 3-cusp hypocycloidal core handling mechanism 218 which is preferred because it uses only continuous, steady, rotary motions—no cams, cranks, or linkages. With the 12 inch diameter mechanism shown in FIG. 11, the maximum acceleration of the core is only 2.5 G's at 60 logs per minute (LPM) which is quite gentle, reasonable, and acceptable. The acceleration is only 5.5 G's at 90 LPM which is also acceptable and reasonable.

Figure 13:
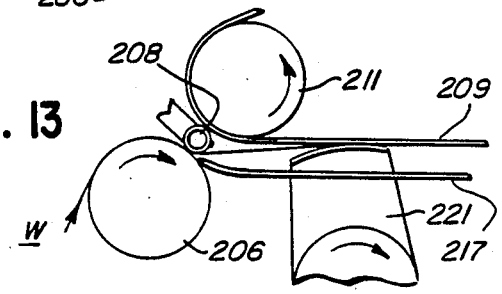

Core handling mechanism 218 makes one revolution (cycle) per finished log produced, moving through paths 226, 227 and 228 defining cusps **226*a*, 227*a* and 228*a*. As seen in FIGS. 12 and 13, during that revolution (cycle) the mechanism 218** holds and carries the core by means of vacuum puck mens. In this embodiment, a continuous stripe of adhesive is laid down and opposite to the side engaged by the vacuum puck means so that a continuous puck can be employed. The mechanism performs 3 tasks during each revolution (cycle).

(1) It picks up a new core from the one-at-a time core escapement wheels 219. The vacuum in the core carrying arms is turned on shortly before the pick-up action.

(2) It presses the core against glue roll 220, which turns slowly in a pan of transfer glue so its surface is always covered with a film of fresh glue. Glue roll 220 turns constantly at fixed speed independent of machine speed (see FIG. 17). This action puts a line of transfer glue on the core at the correct location for transfer (see FIGS. 12, 13 and 14).

(3) It inserts the glued core into the core insertion nip 208 between rolls 206 and 211 at the correct moment in the winding cycle, synchronized with the perforator and pinch-plate mechanism 221 to break and transfer the web onto the new core with exact, constant, sheet count per log. The vacuum is turned off at the moment the core enters the transfer nip 208.

These actions of pick-up, gluing, and inserting are sequential and the sequence is repeated every product winding cycle. FIG. 11 shows mechanism 218 in all three operating positions in order to show these positions on a single sketch.

The mechanism 221 is the pinch-plate mechanism. Its function and purpose is to pinch the web W firmly against the upper belts 209 at the moment of web-break (see FIG. 14). The mechanism is arranged and located so that the distance between point A, where the pinch-plates pinch the web against the upper belts, and point B where the core pinches the web firmly against stationary plate 217, is less than twice the distance between two lines of perforations. It is timed to core insertion and perforation so that the specific line of perforation P to be broken lies intermediate, i.e., about mid-way between points A and B in FIG. 14. The surface speed of the pinch-plates is the same as the speed of the upper belts 209. At point A, the web is moving between the pinch-plates and upper belts at full web speed. At pint B, the web is stationary/stopped between the core and the line of perforations. This yields:

(1) Exact sheet count in each finished log.

(2) Clean web-break at a line of perforations.

(3) A short bit of web (about ½ the distance between A and B) folded back around the core; a relatively neat and attractive transfer quality.

Figure 16:
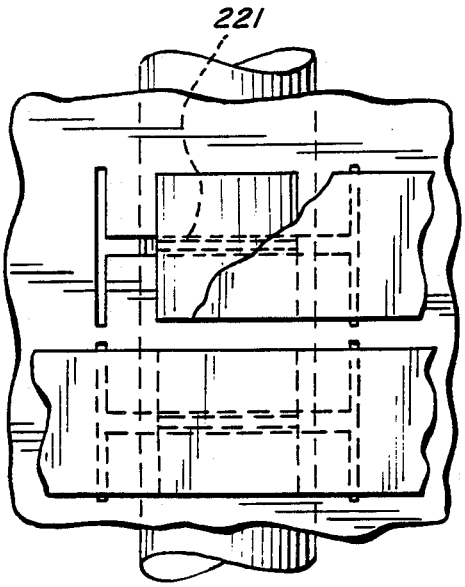
FIG. 16 is a fragmentary top plan view taken along the line 16—16 of FIG. 11.

(4) Reverse-fold foldback around the core which traps both plies of 2-ply webs. FIG. 16 is a view looking vertically downward from above the centerline of the shaft 222 of the pinch-plate mechanism. On the shaft 222 there are several radial arms (one for each belt or upper belts 209) each of which carries a curved pinch-plate which is as long axially as its matching belt is wide. The stationary plate 217, contains an H-shaped hole for each radial arm. These holes allow the pinch-plates to pass through the stationary plate yet the holes are small (narrow) enough not to disturb the web winding around the core as it rolls over the holes. The pinch plates pass through the legs of the H while the radial arms pass through the cross bar of the H-shaped opening.

Pinch-plate mechanism 221 rotates continuously during the entire winding cycle so it pinches the web against upper belts 209 several/many times yet it does not disturb the web flow/winding or break any perforations except at the precise moment of web-break and transfer; once per log. This situation/condition exists because:

(1) Roll 206 is located so that the web path lies on the lower surface of upper belts 209 (see FIG. 12), viz., the upper surface of roll 206 is aligned with the surface of the lower run of belts 209.

(2) The surface speed of the pinch-plates is the same as the speed of the upper belts 209.

The circumference of the circular path of the surface of the pinch-plates is equal to an integer number of sheets times the distance between the perforation lines which define those sheets.

FIGS. 11–16 show a pinch-plate mechanism with a circumference of 45 inches (10 sheets×4½ inches per sheet). This means that the number of sheets in a finished log must be some integer multiple of 10 (100, 130, 210, etc.). Other pinch-plate mechanism sizes are entirely feasible, but they must meet several design criteria:

(1) Circumference of the circular path of the surface of the pinch-plates equals an integer number of sheets times the length per sheet.

Figure 14:
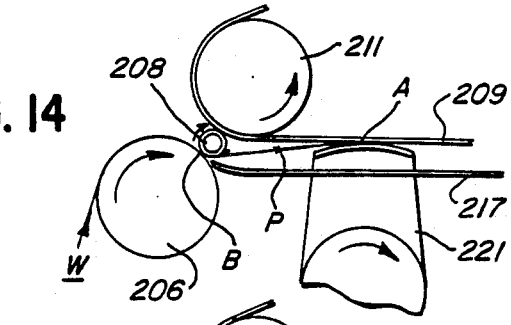

(2) Distance between A and B in FIG. 14 less than two times sheet length. In the U.S. this is less than 9 inches on toilet tissue which is the most demanding application. Less demanding is the European product which has a typical sheet length of 140 mm. (approximately 5½").

(3) Surface speed of the pinch-plates equals speed of upper belts 209 and web speed.

(4) Perforator and pinch-plate mechanism are synchronized so perforator creates N lines of perforation per revolution of the pinch-plate mechanism where N is the integer number of sheets in the circumference of the circular path of the surface of the pinch-plates.

(5) Radius of pinch-plate mechanism (from center line of shaft to outer surface of pinch-plates) must be large enough to accommodate and include:

(a) Core diameter (b) Shaft radius (c) Stationary plate thickness

For example, within these design criteria circumference of 22½ inches (5 sheets×4½ inches per sheet) is feasible. This permits the number of sheets in a finished log to be some integer multiple of 5 (95, 135, 215, etc.). This will be very advantageous for many applications where multiples of 5 sheets in the finished product is desired.

FIGS. 12–15 show what happens in a very brief instant from just before the core is inserted into core insertion nip 208, until the glue line on the core picks up the web and winding begins.

Figure 15:
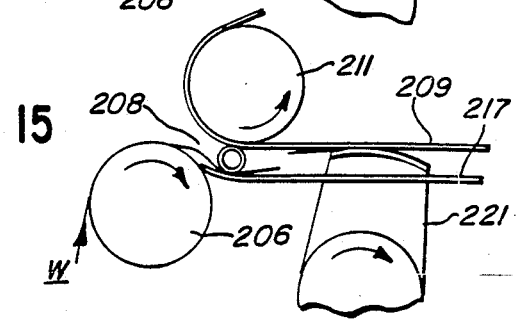

The time from FIG.> 13 to FIG. 15 is a rewinder running 3000 FPM is only about 5 milli-seconds.

(1) The core with its glue line approaches the core insertion nip 208 which is adjusted to be less than the core diameter in order to pinch the core firmly in the nip.

(2) The core is firmly pinched in core insertion nip 208 and it is moved at web speed through the nip by the surfaces of roll 206 and upper belts 209 wrapping roll 211 which are both moving at web speed and in the same direction.

(3) The core rolls onto stationary plate 217 pinching the web firmly against the stationary plate at point B and stopping the web motion. The line of perforations P between A and B breaks.

(4) The core continues rolling on stationary plate 217 until the glue line lies between the core and the severed web (about 6 o'clock on the core in FIG. 15). The glue picks up the web to start winding. Radial acceleration of web and glue at pick-up/transfer is one-fourth that of prior art winding machines. The web behind the core (to the left of glue contact with web) continues to feed creating a slack web (zero tension) which lasts during the first wrap around the core.

(5) The core, with the initial wraps of web, rolls rapidly to the nip 223 between the two slightly divergent, co-acting belt systems 209 and 210. More particularly, this nip 223 is provided with roll 214 and upper belts 209. This is where the horizontal motion of log being wound shows substantially and "double-belt" winding begins and continues until the log is completed as at 207.

At 3000 FPM, the time from FIG. 13 until the core reaches 12 o'clock relative to roll 214 (Nip 223) is only about 63 milli-seconds (about 38 inches of paper). There are several unique features in this transfer and cut-off/web-break concept.

(1) Web fold-back at the core is "reverse" fold which traps both plies of 2-ply webs and makes high speed (3000 FPM) feasible with 2-ply webs.

(2) When the glue line on the core reaches 6 o'clock where the core presses the glue against the web creating transfer of the severed web to the core, the radial acceleration transfer is very low compared with prior art winders.

(3) The core irons the glue line against the web 3 times before the first wrap around the core is completed. By contrast:

(a) On a prior art center-wind rewinder, the transfer pads iron the web against the glue only once.

(b) On a rewinder, according to the '877 patent, the core irons the glue against the web only twice.

(4) The glue line on the core covers the entire web width for best possible transfer action. By contrast, on prior art rewinders, the transfer glue is applied to the core as narrow rings which cover much less than ½ the web width.

(5) During the initial rotation of the core after web break-off until the glue line reaches 12 o'clock, the winder does not take away all the web being perforated. This creates a brief period of low web tension (virtually zero), which means that the transfer glue does not have to overcome any web tension and the first wrap around the core will be somewhat loose and wrinkled. This is a minor disadvantage compared to the result produced by the embodiment of FIGS. 1–10 but is completely justified in terms of the significant reduction in machine complexity. Thereafter the united web and core advance to the nip 223 defined by an intermediate point in the run of the upper belts 209 and the upstream end of the lower belts 210.

(6) The whole process is independent of core diameter.

The modification of FIG. 11 also permits the opportunity to include a unique feature which has never been used before. A dancer roll can now be positioned between the perforator and winding to control winding tension directly.

Also, there are some variations of this new "double-belt" surface rewinder concept which may be useful in some applications:

(1) Eliminate the pinch-plate mechanism 221. The machine still makes logs reliably, but the logs contain quality defects which may be unacceptable.

(a) Sheets per log will vary plus or minus 5 sheets (approximately).

(b) Break-off may be on two or more different lines of perforations, leaving a ragged, uneven, tail on the log.

(c) Tail folded back around the core may be as long as 5 sheets.

(d) With 2-ply webs, the two plies may break at different lines of perforations (2) Eliminate the pinch-plate mechanism 221 and by means of a double flexing blade perforator which makes a very weak line of perforations, instead of the normal line of perforations, once per winding cycle. Then time core insertion in the transfer nip to occur shortly (2 to 3 inches) after the very weak line of perforations passes that nip.

(3) For non-perforated products, eliminate the pinch-plate mechanism 221 and make a line of perforation once per winding cycle. Then time core insertion in the transfer nip to occur shortly (2 to 3 inches) after the line of perforations passes that nip.

Features and Advantages of FIG. 11 Embodiment (1) All motions and actions are continuous, steady and rotary. There ar no cams, cranks, indexers, or similar devices.

(2) Performance up to 60 LPM and above 3000 FPM.

Figure 18:
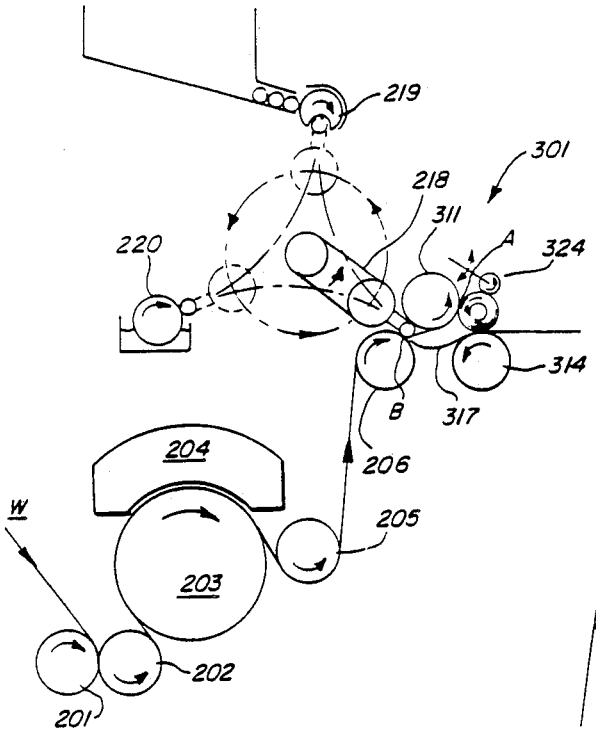
FIG. 18 is a schematic side elevational view of a modified form of machine embodying a different surface winder but utilizing the hypocycloidal core feeder.

Other modifications include the use of the hypocycloidal core feeder 218 in combination with a prior art surface winder 301 of the '877 patent type as seen in FIG. 18.

In the embodiment of FIG. 18 relative to the winder 301, winding is achieved by coaction of a three roll cluster including rolls 311, 314 and a rider roll 324. Cutoff is achieved through cooperation of the roll 311 and the stationary plate 317 much as in the operation previously described with reference to FIG. 14 where the core holds the web against the stationary plate at B and the product being wound creates a second holding point as at A.

Figure 18A:
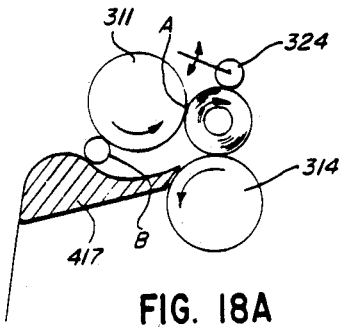
FIG. 18A is a fragmentary view of the central portion of FIG. 18 showing a further modification.
Figure 19:
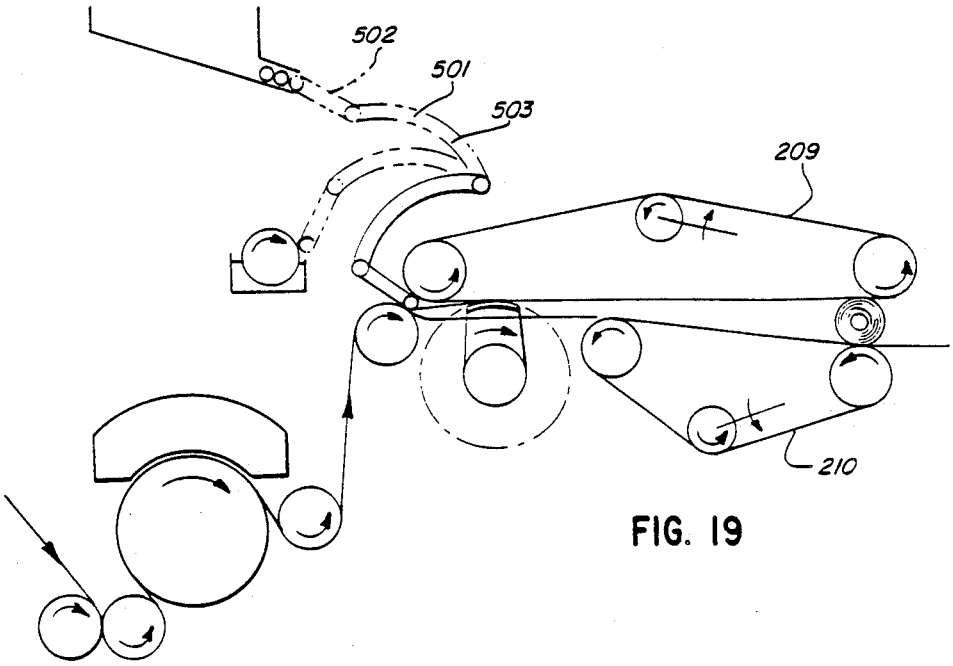
FIG. 19 is a schematic side elevational view of yet another modification embodying a different core feeder with the dual belt winder.

The same operation is possible by a modified version as seen in FIG. 18A. There, the winding cradle rolls are the same as in FIG. 18 but a larger stationary plate 417 is provided—thereby eliminating the lower nip forming roll 206. Also possible is the use of a conventional core feeder 501 in conjunction with the inventive surface winder having belts 209, 310 as seen in FIG. 19. The feeder 501 has an articulated arm 502 which moves from a core pick-up station to an adhesive pick-up station to a nip station while under the control of a pivot arm 503.

While in the foregoing specification a detailed description of an embodiment of the invention has been set down for the purpose of illustration, any variations in the details herein given may be made by those skilled in the art without departing from the spirit and scope of the invention.

I claim:

1. In a method of winding a web on a series of cores, said web having longitudinally spaced transversely extending lines of perforations, the steps of advancing said web along a path, pinching said web at a first point in said path while said web is advancing, and using a core to pinch said web against a stationary plate at a second point upstream of said first point and while a line of perforations is positioned between said points.

2. The method of claim 1 in which said first point is provided by the coaction of a log of paper being wound on a preceding core and a surface traveling at the speed of said web.

3. The method of claim 2 in which said surface is the surface of a cradle roll.

4. The method of claim 2 in which a plurality of said lines of perforations are provided for each log being wound.

5. The method of claim 2 in which a single line of perforations is provided for each log being wound.

6. A surface winder for winding a perforated web on a series of cores comprising a frame, a roll rotatably mounted on said frame in the path of web travel when said web is being wound on a core to provide a log, a stationary plate on said frame adjacent to but spaced from said roll to accommodate a core therebetween and provide a first pinch-point for said web, and means on said frame downstream in the path of web travel from said first pinch point for engaging the surface of said log to provide a second pinch point cooperative with the first pinch point provided by said stationary plate, core and roll to tension the web between said pinch points and cause web severance along a line of perforations between said pinch points.

7. The winder of claim 6 in which said engaging means is a position on the surface of said roll angularly related to the roll surface position defining said first pinch point.

8. The winder of claim 6 in which said engaging means is a belt partially wrapped on said roll and extending along the path of travel in passing from said roll to said log.

9. A surface winder for winding a web on a series of cores comprising a frame defining a web path having an entering end and a discharge end, first winding roll on one side of said path adjacent said path entering end, a second winding roll on the opposite side of said path spaced downstream from said entering end, a rider roll on said one path side downstream of said first winding roll, a stationary plate on said frame on the opposite side of said path and operative with said first winding roll to pinch the web between a core and said stationary plate whereby the rotation of the winding rolls creates a web tension to sever the web.

10. A method of winding a web sequentially upon a series of cores wherein the web (W) has equally longitudinally spaced lines of transverse perforations and which is advanced along a path having an upstream web pinching point (B) and a spaced downstream pinching point (A) with the pinching points (B), (A) being arranged to over-tension the web and cause severance thereof along a line of perforations (P) located between said point (B), (A) characterized by defining the point (B) by a new core (C) to be wound and a stationary plate (217, 317, 417), maintaining the web continually under tension between the core (C) and the downstream pinching point (A) and inserting a new core between said stationary plate 217, 317, 417 and a winding roll (211, 311) to cause severance to occur when the web is pinched against stationary plate (217, 317, 417).

* * * * *